US008739669B2

(12) United States Patent
Engdahl et al.

(10) Patent No.: US 8,739,669 B2
(45) Date of Patent: Jun. 3, 2014

(54) VEGETABLE AND FRUIT SLICER AND METHOD FOR SLICING

(75) Inventors: Benny Engdahl, Vallentuna (SE); Kerstin Engdahl, legal representative, Vallentuna (SE); Nikola Knezevic, Marsta (SE); Daniel Ericsson, Huddinge (SE); Johan Vestberg, Stockholm (SE); Mikael Ericsson, Hägersten (SE)

(73) Assignee: EPU AG, Hergiswil (CH)

( * ) Notice: Subject to any disclaimer, the term of this patent is extended or adjusted under 35 U.S.C. 154(b) by 1277 days.

(21) Appl. No.: 12/525,048

(22) PCT Filed: Jan. 31, 2008

(86) PCT No.: PCT/SE2008/050122

§ 371 (c)(1),
(2), (4) Date: Sep. 8, 2009

(87) PCT Pub. No.: WO2008/097178

PCT Pub. Date: Aug. 14, 2008

(65) Prior Publication Data

US 2010/0031830 A1 Feb. 11, 2010

Related U.S. Application Data

(60) Provisional application No. 60/899,873, filed on Feb. 7, 2007.

(30) Foreign Application Priority Data

Feb. 6, 2007 (SE) ..... 0700295
Feb. 7, 2007 (DE) ..... 20 2007 002 039 U
Apr. 26, 2007 (SE) ..... 0701004

(51) Int. Cl.
*B26D 1/02* (2006.01)

(52) U.S. Cl.
USPC ..... 83/858; 83/856; 83/932; 83/404.3; 83/425.1

(58) Field of Classification Search
USPC ..... 83/858, 932, 607, 599, 856, 857, 404.3, 83/404.4, 425.1, 425.2; 606/537
See application file for complete search history.

(56) References Cited

U.S. PATENT DOCUMENTS 2,073,257 A * 3/1937 Van Riper ..... 83/581.1
3,163,192 A 12/1964 Lupoli
(Continued)

FOREIGN PATENT DOCUMENTS

EP 1375091 A1 1/2004
EP 1 574 304 A1 9/2005
(Continued)

*Primary Examiner* — Omar Flores Sanchez
(74) *Attorney, Agent, or Firm* — Dickstein Shapiro LLP

(57) ABSTRACT

A vegetable and fruit slicer for slicing vegetables and fruit comprising a knife part (1) and a cooperating anvil part (2). The knife part (1) comprises at least two sets of knives (3), where a set of knives (3) comprises at least two knives (4) arranged at predetermined lateral distances and predetermined level distances from each other forming a stair or a fan (3). Only one knife (4) of each set (3) is positioned at each level and the lateral distances between the knives (4) positioned at the same level are the same and constant for each level of knives (4). A method, wherein a first level of at least two knives (4) starts cutting the vegetable or fruit to be cut, followed by at least a second level of a preferably corresponding number of knives (4) and having the same internal distance in between the knives in every level.

9 Claims, 7 Drawing Sheets

(56) References Cited

U.S. PATENT DOCUMENTS

Figure 1:
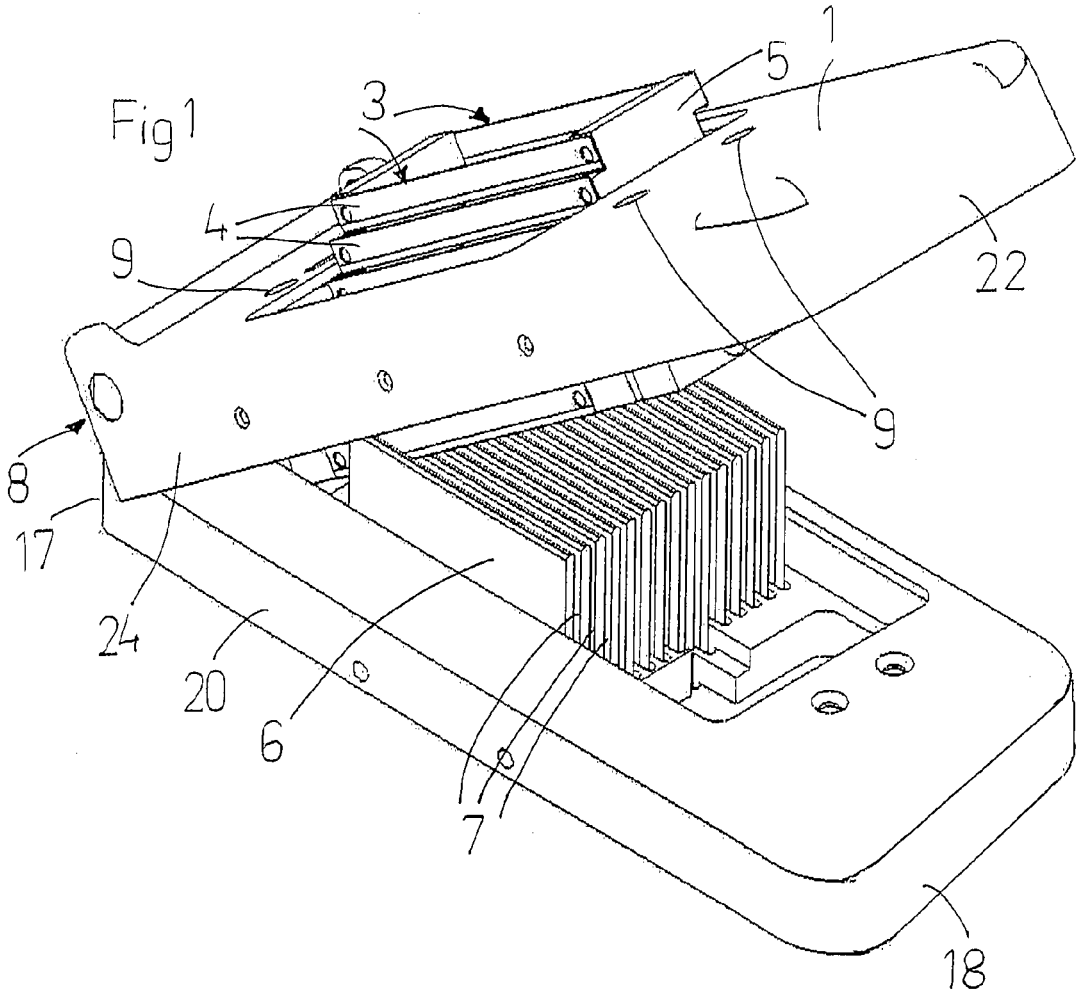

| | | | | |
|---|---|---|---|---|
| 4,625,607 | A | 12/1986 | Maillez et al. | |
| 5,095,794 | A * | 3/1992 | Mendenhall | 83/858 |
| 5,125,308 | A * | 6/1992 | Mendenhall | 83/857 |
| 6,209,439 | B1 * | 4/2001 | Repac et al. | 83/858 |
| 6,601,491 | B1 * | 8/2003 | Jensen | 83/62.1 |
| 6,725,765 | B1 * | 4/2004 | Mendenhall | 99/537 |
| 6,959,636 | B2 * | 11/2005 | Graziano | 83/857 |
| 7,096,771 | B2 * | 8/2006 | Mendenhall | 83/857 |
| 7,392,729 | B2 * | 7/2008 | Baddepudi | 83/607 |
| 7,992,476 | B2 * | 8/2011 | Kaposi | 83/167 |
| 8,181,560 | B2 * | 5/2012 | Hauser et al. | 83/858 |
| 2004/0194597 | A1 * | 10/2004 | Graziano | 83/425 |
| 2010/0236372 | A1 * | 9/2010 | Desailly et al. | 83/857 |
| 2011/0072985 | A1 * | 3/2011 | Gaus | 99/537 |

FOREIGN PATENT DOCUMENTS

| | | | |
|---|---|---|---|
| WO | WO 02/064331 | A1 | 8/2002 |
| WO | WO 2006/049639 | A1 | 5/2006 |

* cited by examiner

VEGETABLE AND FRUIT SLICER AND METHOD FOR SLICING

The present invention concerns a vegetable and fruit slicer comprising a knife part and a cooperating anvil part and a method for slicing vegetables and fruit.

BACKGROUND ART

The cutting and slicing of vegetables requires time and skill using a knife in order to achieve uniform slices, for example. Many attempts have been done to make products for facilitating cutting and slicing of vegetables and fruits.

SUMMARY OF THE INVENTION

The object of the present invention is to provide a vegetable and fruit slicer and a method for slicing that with ease cuts difficult and/or hard vegetables as tomatoes, raw potatoes and raw carrots in nice slices.

The object is met by a vegetable and fruit slicer according to claim 2 and a method for slicing vegetables and fruit according to claim 21. One advantage with the slicer and method according to the invention is that the usage of at least two sets of knives will assure that not all knives start cutting at the same time and stability in the slicing is achieved, resulting in even slices and an easy pushing movement.

This has an excellent effect on cutting tomatoes as the skin of tomatoes is very difficult to cut through and this feature will avoid compressing the tomato. This will also minimize the lateral pressure on the knives and thus less pressure need to be applied in the cutting direction. In this way it will be easier to cut through hard vegetables and fruits like raw carrots, potatoes and apples.

Another advantage with the present invention is that said at least two sets keep a constant lateral distance between the knives for each level of knives, which may result in that the sets incline in the same direction and with the same inclination, if the lateral distances between each level in each sets of knives is the same, i.e. if all the slices are meant to be of the same thickness, which of course is preferred.

Having these constant distances between the knives of each level will stabilize the slicing so that the slices will be more even in thickness and minimize the risk that the knives will cut obliquely or tend to curve thus cutting thicker and thicker slices or vice versa. Any arising obliqueness or curving will be compensated for by the other knife/knives in the same level of knives.

The knives in the sets of knives may for example be arranged in parallel so that the knives look like a stair or with angular displacement so the knives looks like a fan. The compensation of any arising obliqueness or curving may not be achieved if the stairs or fans incline in opposite directions, for example if the knives are arranged in V or wave shape.

Preferably the anvil part comprises an anvil with a corresponding recess for each knife in the knife part. In a preferred embodiment of the invention the knife part and the anvil part are swingably connected to each other via at least one hinge positioned transversally of the extension of the knives. This will give an advantageous angular motion enhancing the cutting. Preferably guiding means for guiding the knives into the recesses at use is/are provided at one of or at both the knife part and the anvil part.

In a preferred embodiment of the knives they have a toothed cutting edge. Preferably the cutting edges have non-linear form showing tops and valleys. In this way the teeth engage and start cutting at different moments and thus spreading the cutting in a corresponding way to have the knives in stairs. To achieve the best result each point of the tops has only one tooth.

A removable cleanser can be provided in the anvil having one rung positioned in each recess. Such a cleanser is a great advantage in practice for facilitating the cleansing of the anvil.

In a further embodiment of the present invention the knives are prestressed by pressure applied at the ends towards each other so that they are slightly bent in the direction of extension. Preferably, the knives are angled 5-15 degrees from their straight extension. This will even further minimize the obliqueness or curving of the knives during the slicing operation.

SHORT DESCRIPTION OF THE DRAWINGS

Figure 2:
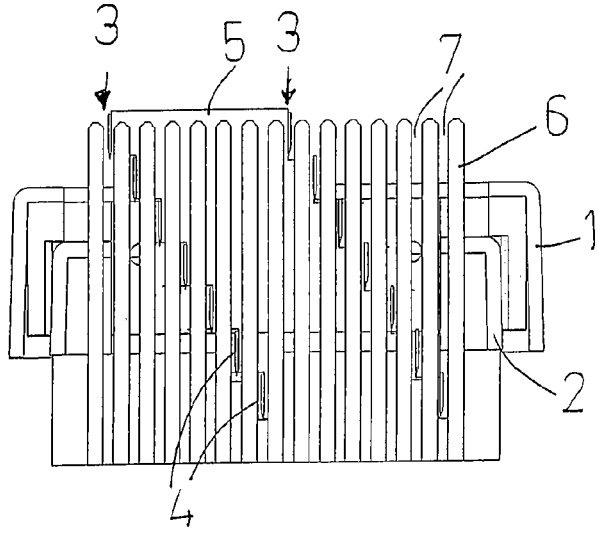
Figure 3:
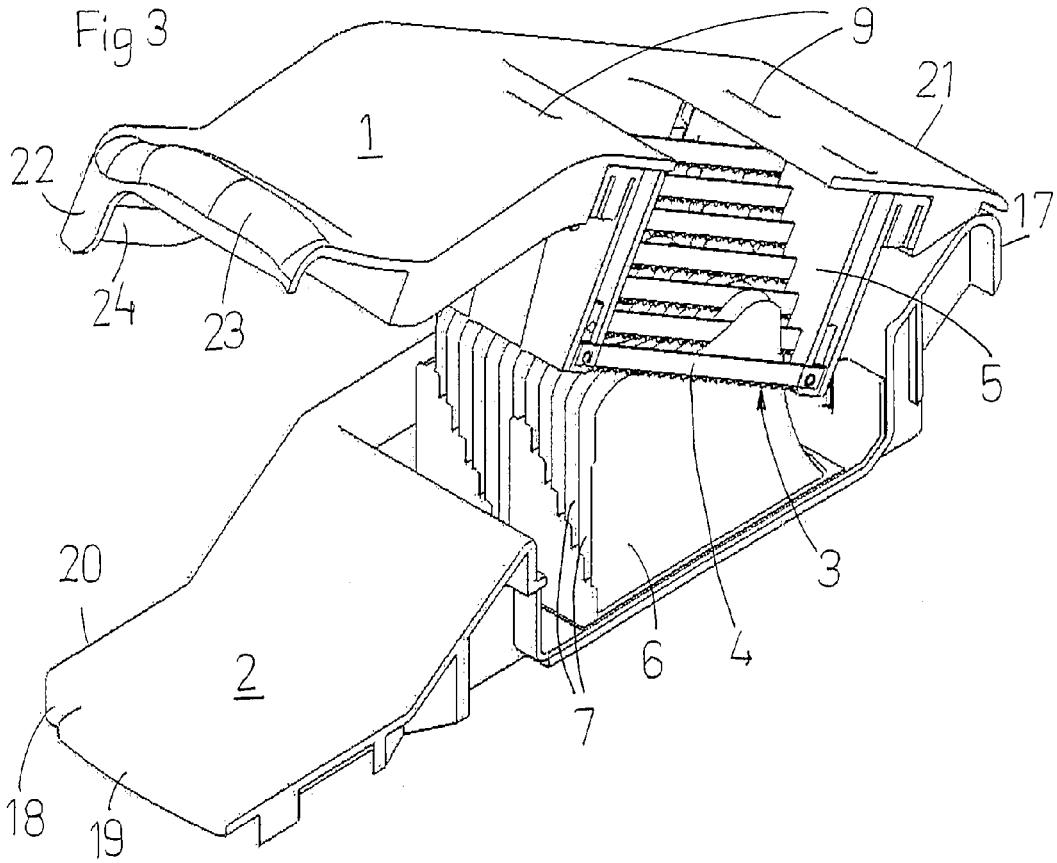
Figure 4:
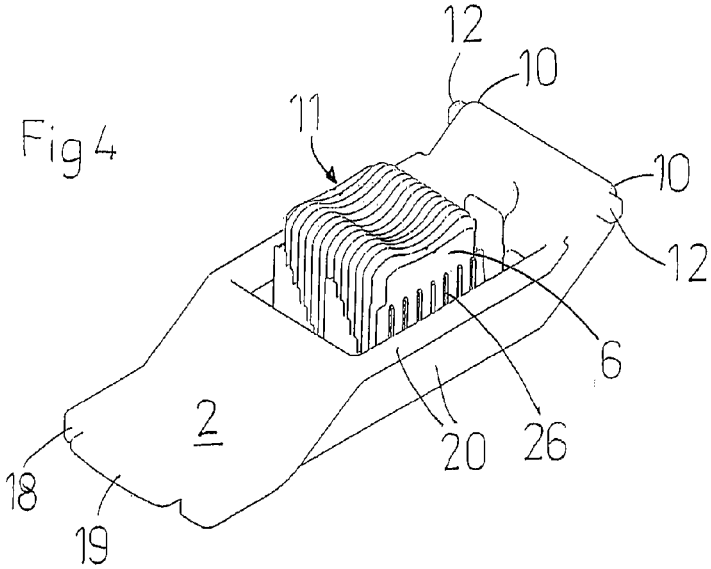
Figure 5:
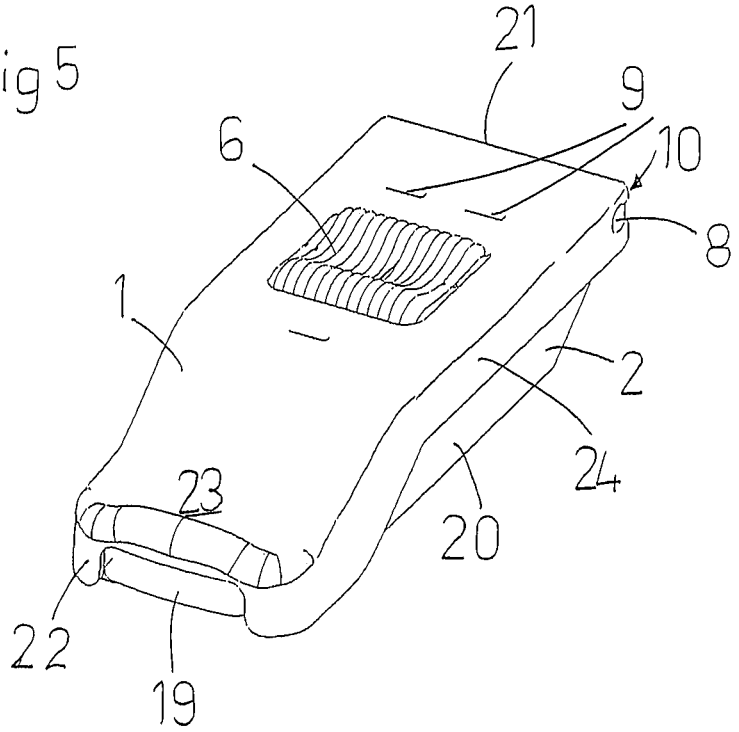
Figure 6:
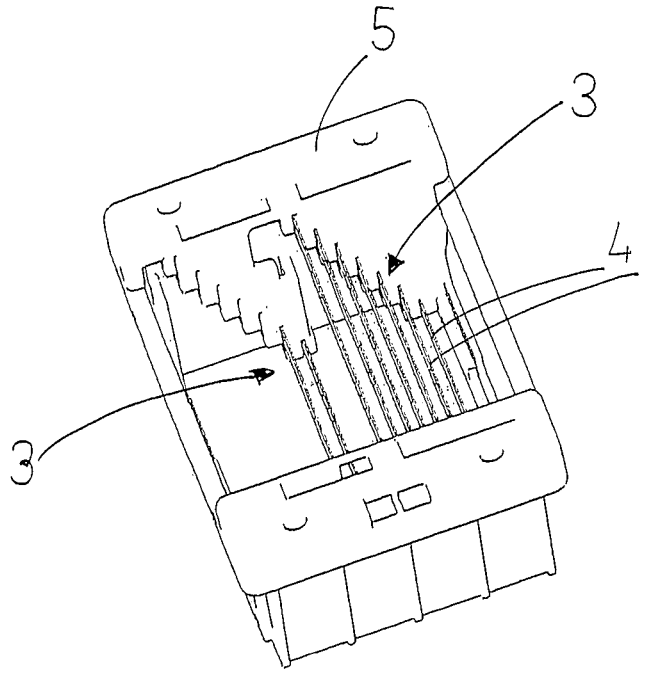
Figure 7:
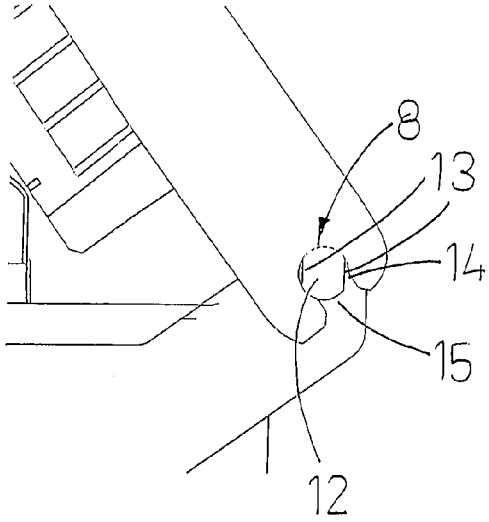
Figure 8:
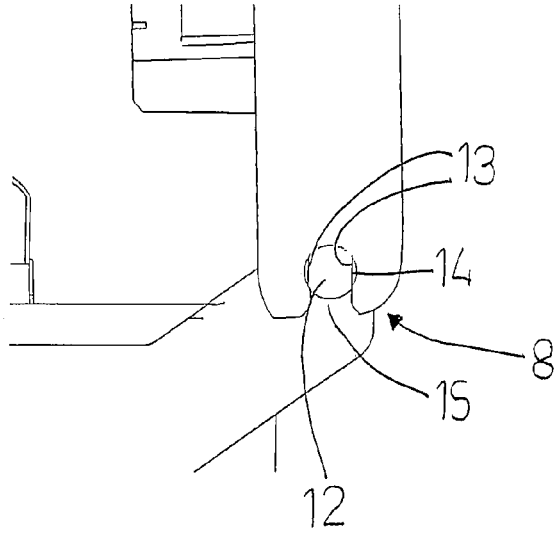
Figure 9:
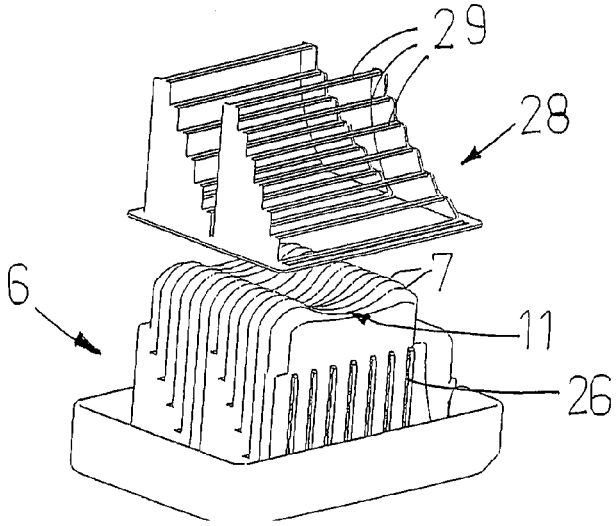
Figure 10:
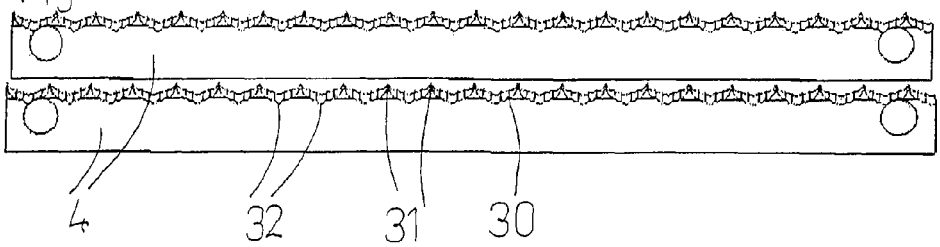
Figure 11:
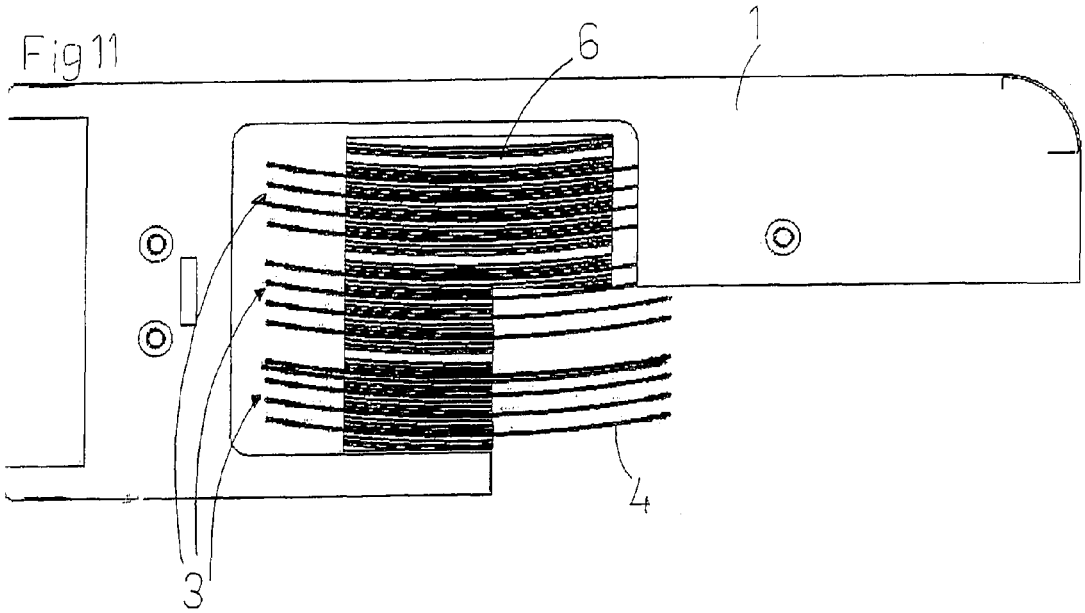
Figure 12:
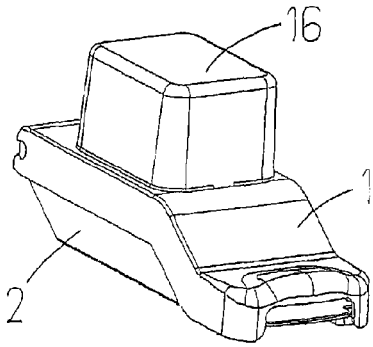
Figure 13:
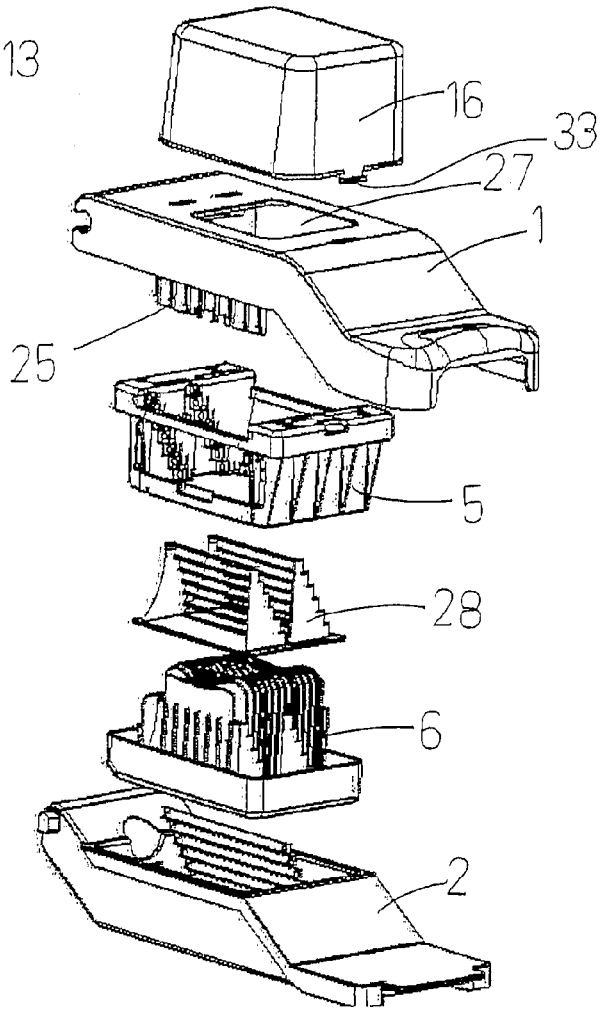
Figure 14:
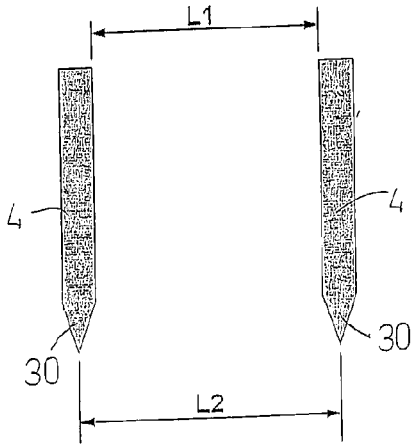
Figure 15:
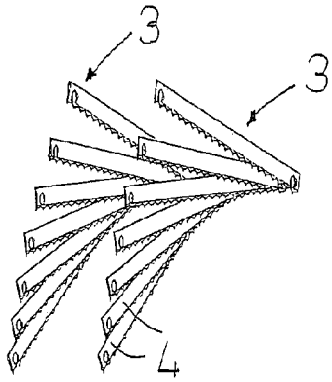
Figure 16:
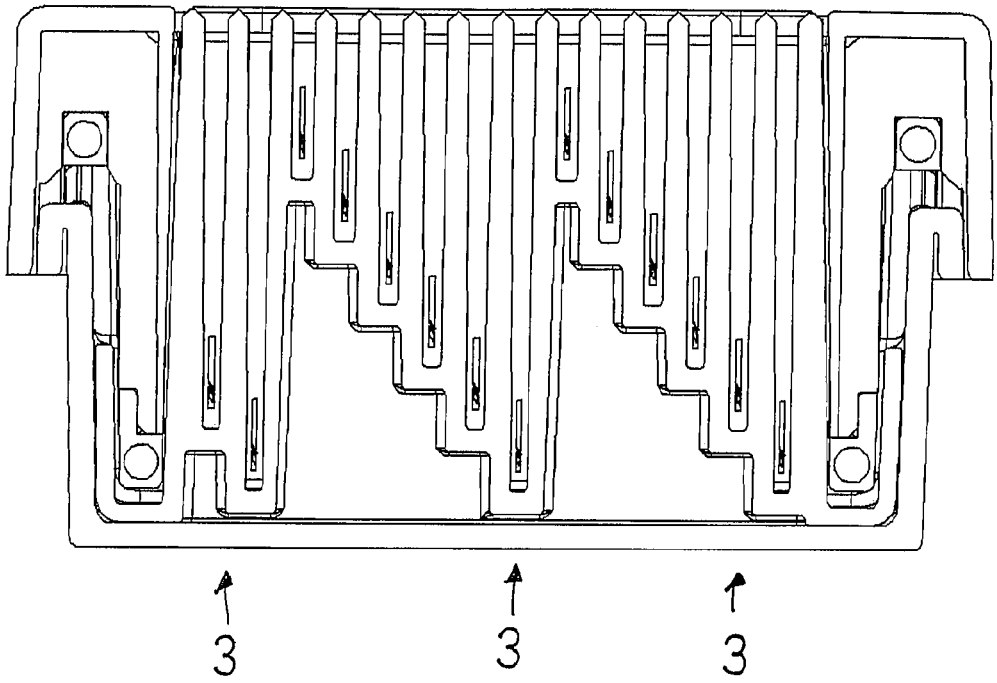
Figure 17:
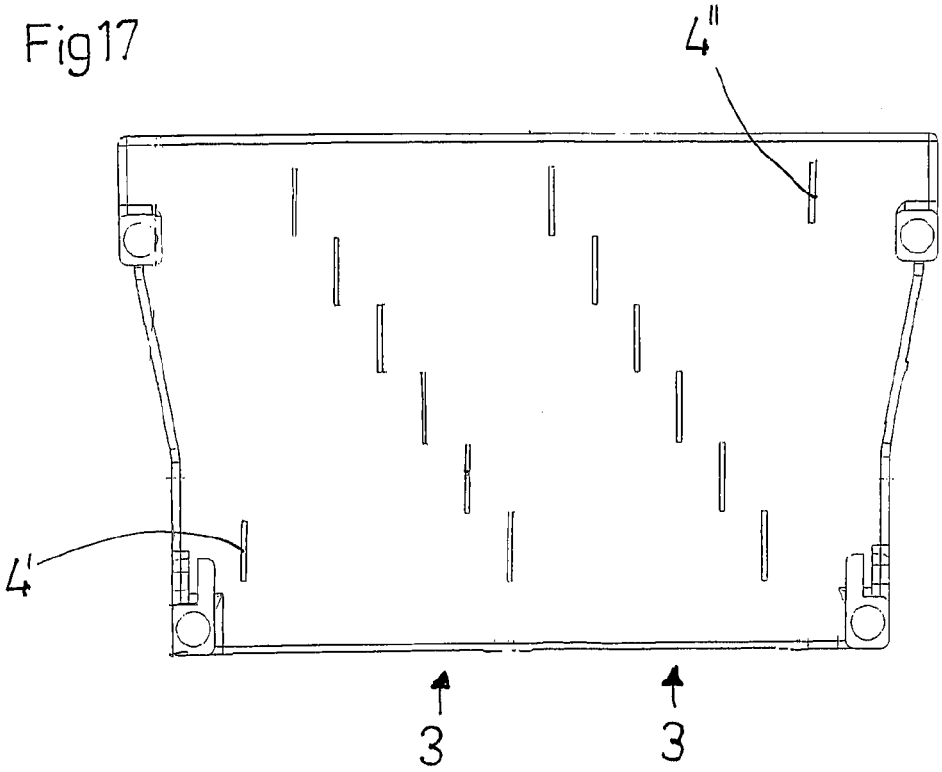

The preferred embodiments of the present invention will now be described in view of the appended drawings, in which:

FIG. 1 shows a first embodiment of a slicer according to the present invention in a half open position, FIG. 2 shows the embodiment of FIG. 1 in a transversally cut through view, in a closed position exhibiting two sets of knives positioned in an anvil, FIG. 3 shows a second embodiment of a slicer according to the present invention in a longitudinally cut through view, in a half open position exhibiting one of the two sets of knives, FIG. 4 shows an anvil part of the second embodiment in a perspective view from above, FIG. 5 shows the second embodiment in a closed position in a perspective view from above, FIG. 6 shows a preferred embodiment of a knife block with two sets of knives in a perspective view from above, some of the knives in one of the sets are taken away, FIG. 7 shows a preferred embodiment of connection between the knife part and the anvil part of the slicer, a hinge in a half open position, FIG. 8 shows the hinge of FIG. 7 in an open position, in which the two parts are dismountable, FIG. 9 shows a cleanser adapted for the second embodiment FIG. 10 shows a preferred embodiment of knives suitable for the present invention, FIG. 11 shows a third embodiment of a slicer according to the present invention from above exhibiting three sets of knives, where the knives are slightly bent, FIG. 12 shows a collector receptacle mounted to the slicer of the second embodiment, FIG. 13 shows a slicer of the second embodiment in an exploded view, FIG. 14 shows the distances between two knives, FIG. 15 shows another arrangement of the knives in two sets of knives, FIG. 16 shows a fourth embodiment of a slicer according to the present invention showing three sets of knives where one set comprises less numerous knives then the other two, and FIG. 17 shows a fifth embodiment of a slicer according to the present invention showing two full sets of knives and two parts of sets of knives positioned one at each side.

DETAILED DESCRIPTION OF PREFERRED EMBODIMENTS

In FIG. 1 a first embodiment of a slicer according to the present invention is shown. It comprises a knife part 1 and a cooperating anvil part 2, against which the knife part 1 can be pushed thereby effecting a cutting up of vegetables or fruit provided in between the knife part 1 and the anvil part 2. The knife part 1 comprises at least two sets of knives 3, see also FIG. 2.

A set of knives 3 comprises at least two knives 4 arranged at predetermined lateral distance and predetermined level distance from each other forming a stair or a fan, where each knife 4 constitutes a step in the stair or fan 3. In the shown embodiment two stairs of knives 3 are provided comprising seven knives 4 each.

Each set of knives 3 comprises "cycle" of knives, i.e. when a stair or fan is completed a new set of knives 3 starts with a knife 4 coming first into contact with the fruit or vegetable to be cut and adding up to a new "cycle"/set of knives 3 along the stair or fan up to the knife 4 last to come into contact with the fruit or vegetable to be cut.

The knives 4 are attached in a knife block 5 arranged in the knife part 1. The knives 4 may for example be screwed, riveted, glued to or moulded into the knife block 5. The knife block 5 is preferably made of a polymer. Preferably the knife block 5 is removably attached in the knife part 1, for example by means of snapping means (not shown), in a recess 27 of the knife part 1.

Only one knife 4 of each set 3 is positioned at each level (step) and the lateral distances between the knives positioned at the same level are preferably the same and constant for each level of knives 4. The stairs or fans 3 thus incline in the same direction and with the same inclination, of course somewhat curved for the fan variant.

In the anvil part 2 an anvil 6 is provided. The anvil 6 cooperates with the sets of knives 3 to slice any vegetable or fruit placed in between the two parts (knife part 1 and anvil part 2) when the two parts 1, 2 are pushed together. Preferably the anvil 6 is removably connected to the anvil part 2, for example by means of snapping means. This will facilitate the cleaning of the slicer and anvil 6.

Preferably the anvil 6 is provided with recesses 7 into which the knives 4 can be pushed during slicing. The recesses 7 should at least extend a distance into the anvil 6 corresponding to the depth the knife 4 at the corresponding lateral position will be pushed when the slicer reaches its closed position. See FIGS. 3, 4 and 9.

It is also possible to provide an anvil 6 where every recess 7 extends as far as the knives 4 of the first cutting level, i.e. the knifes that will first cut into the vegetable or fruit to be cut, will reach when the slicer is in the closed position, see FIG. 2. The previously described embodiment will be a more rigid anvil 6 than the latter.

The anvil 6 may in the preferred embodiment be provided with a cavity 11 for the vegetable or fruit to be cut to rest in. This will improve the cutting result due to the fact that the vegetable or fruit to be cut will not be able to slide over the anvil 6 during the cutting. At the opening end of the recesses the anvil 6 is preferably chamfered in order to guide the knives 4 if they tend to slightly bend or so.

The knives of the last cutting level, i.e. the level of knives 4 that will be the last ones to cut the vegetable or fruit to be cut, should at least partly run into the correspondingly positioned recess 7 in order to secure fully through cut of the vegetable or fruit to be cut.

Advantageously, all the knives 4 will fully run into the recesses 7 of the anvil 6 when the vegetable or fruit is cut, i.e. the slicer is in its closed position. In this way it will be easy to wipe or push off the sliced vegetable or fruit, especially if the knives and anvil stops at the same level.

It is also possible to have a collector receptacle 16, see FIG. 12, provided covering the stairs of knives 3 on the outside of the knife part 1 into which the slices of vegetables or fruits can be collected. The position of the knives of the last cutting level is not as important in this embodiment having a collector receptacle 16 provided. The collector receptacle 16 may for example be removably attached at the outside of the knife part 1 with protrusions 33 fitting into recesses 9 on the knife part 1.

The knife part 1 and the anvil part 2 are preferably pivotably connected with each other by means of at least one hinge 8, preferably two coaxial hinges 8, one at each end corner 10. The axis of the hinge 8 is provided in the slicer transversally to the extension of the knives 4. In such an embodiment, the cavity 11 of the anvil 6 is preferably provided closer to the hinged end of the slicer than the free end of the slicer.

In the preferred embodiment the anvil part 2 is designed to be placed on a table or any other base and thus the knife part 1 when in use can perform a swinging movement down towards the anvil part 2 and to and through a vegetable or fruit placed on the anvil 6 so that the latter can be sliced.

Of course the opposite is conceivable, that the knife part 1 is placed underneath the anvil part 2. If that is the case it is preferred that a collector receptacle 16 is mounted so that a space results in between the knives 4 and the base, such as a table, so that the slices will have enough room to proceed through and out of the knives 4.

The hinge or hinges 8 are preferably dismountable, see FIGS. 7 and 8. One of the advantages is that the slicer will be easier to clean. In a preferred embodiment of the hinges 8 the anvil part 2 is provided with taps 12, one at each corner 10, coaxially oriented transversally to the extension of the knives 4. The taps 12 have a circular cross section that is cut at opposite sides in a vertical direction when the anvil part 2 is placed on a horizontal surface. The cuttings give the taps 12 two opposite, vertical, planar faces 13.

The knife part 1 is provided with cooperating recesses 14 that take up the taps 12 inside. The recess 14 is preferably a hole and it is provided with an opening 15 towards the end of the knife part 1. The width of the opening 15 corresponds to the width between the planar faces 13 of the taps 12 so that the taps 12 can be inserted through the opening 15 when the knife part 1 is in the position in relation to the anvil part 2 that the planar faces 13 of the taps 12 are in line with the opening 15. In the shown embodiment it is when the knife part 1 is in an open, vertical position.

The opening 15 must be narrower than the diameter of the taps 12. In that way the knife part 1 and the anvil part 2 could only be dismounted in only one position and will not fall apart in unwanted situations. Of course it is possible that the recess 14, i.e. the hole and opening 15 are covered or not through going. It is also conceivable to arrange the hinges 8 in the opposite way, i.e. the taps being arranged at the knife part 1 and the recesses in the anvil part 2.

The anvil part 2 preferably surrounds the anvil 6 and extends a bit towards the hinge end 17 and also extends from the anvil 6 in the opposite direction to the hinge end, i.e. towards a free end 18. Preferably a grippable tongue 19 protrudes from the free end 18. This will facilitate the opening of the slicer since a user can put one hand at the tongue 19 while lifting the knife part 1.

The anvil part 2 has advantageously a certain height, for example a few centimeters, making up vertical side walls 20. The portion between the anvil 6 and the free end 18 is preferably roughly of the same width as the anvil 6 in order to enhance the balance when slicing.

The knife part 1 correspondingly surrounds the sets of knives 3 and extends towards its hinge end 21 and also extends from the sets of knives 3 in the opposite direction to the hinge end, i.e. towards a free end 22. This will give a lever effect to the swinging motion when pushing the knives 4 through the vegetable or fruit to be cut.

Preferably the knife part 1 lowers towards the free end 22 and ends with a comfortable handgrip portion 23 for the hand that pushes the knife part 1 downwards to the anvil part 2, see FIGS. 3 and 5. Preferably this portion also has roughly the same width as the rest of the knife part 1 to enhance the balance during the slicing motion. The knife part 1 is provided with side walls 24 that preferably will be positioned outside the side walls 20 of the anvil part 2 in the closed position of the slicer.

Guide means (not shown) is/are preferably arranged at the inside of the side walls 24 of the knife part 1 and/or at the outside of the side walls 20 of the anvil part 2. Preferably guide means 26 are provided at the longitudinal sides of the anvil 6, see FIGS. 4 and 9, to cooperate with guide means 25 arranged in the knife part 1, see FIG. 13. The guide means 25 in the knife part 1 protrude from the inside of the knife part 1, one at each longitudinal side of the recess 27 for the knife block 5. The guide means are provided for a controlled swinging and pushing motion while slicing so that it is secured that the knives 4 will run into the recesses 7 in the anvil 6.

When the knife block 5 is attached in the knife part 1, according to the second embodiment, the guide means 25 cooperate with the knife block 5 so that the sets of knives 3 will be surrounded by four walls.

A great advantage is a cleanser 28 that preferably is comprised in the slicer according to the invention. In FIG. 9 it is shown in an embodiment suitable for the second embodiment of the slicer. The cleanser 28 has rungs 29, one for each recess 7 of the anvil, so that the cleanser 28 may be inserted in the anvil 6 before the start of a slicing procedure. After the slicing procedure the cleanser 28 is taken out of the recesses 7 of the anvil 6 and thereby cleansing the recesses 7 of any residual vegetable or fruit present in the recesses 7. In this way the washing up of the slicer will be facilitated.

In FIG. 14 the distance L1 between two knives 4 is shown. The knives 4 have cutting edges 30 and the distance L2 between the cutting edges 30 is longer then the distance L1 between the knives 4. When a vegetable or a fruit is to be cut the cutting edges 30 starts to run into the vegetable. When the knives 4 have run as deep into the vegetable that the cutting edges 30 have disappeared the normal thickness of the knives 4 starts to run into the vegetable, but the distance L1 between the knives 4 is less than the distance L2 that the cutting started with.

Thus a slice of the vegetable with a thickness corresponding to L2 is pressed into the gap between the knives having the shorter distance L1. Thus the vegetable slice will press the knives 4 from each other. When having a lot of knives 4 starting the cutting at the same time this distance differences will add up and increase the pressure on the knives 4. For example, if six knives of the dimension 0.5 mm at the same time should cut a vegetable the vegetable needs to give room for 3 mm of knife material.

Either the knives 4 will bend and slice thicker and thicker slices or it will get stuck, for example in the anvil 6, or by the large pressure giving rise to too high friction forces. The present invention is a solution to this problem since only one knife 4 from each set of knives 3 will start cutting at the same time. In the first and second embodiment of the present invention it will only be two knives 4 at the time that starts cutting.

This is the case when using only a pushing movement, as in the present invention, but if instead an oscillating movement was used, this would not really be a problem as the knives would tear off material from the fruit or vegetable to be cut during the oscillating movement so that the knives would make space for themselves during the cutting through. Thus the lateral pressure between the knives would be very small. The solution according to the present invention takes care of the lateral pressure problem of the knives using only a pushing movement, without the need of an oscillating movement.

Another advantage with the present invention is that the at least two sets keep a constant lateral distance between the knives for each level of knives, which result in that the stairs incline in the same direction and with the same inclination. Having these constant distances between the knives of each level and the same inclination will stabilize the slicing so that the slices will be more even in thickness and minimize the risk that the knives will cut obliquely or tend to curve thus cutting thicker and thicker slices or vice versa.

Any arising obliqueness or curving will be compensated for by the other knife/knives in the same level of knives. If the cutting edge 30 is made of only one oblique side instead of two as in FIG. 10, the best cutting effect and compensating effect will be achieved if all the knives 4 are oriented with the oblique side in the same direction. The compensation of any arising obliqueness or curving may not be achieved if the stairs or fans incline in opposite directions, for example if the knives are arranged in V or wave shape.

As an example the distance between the knives 4 viewed from above, i.e. the given thickness to the slices, may be 2-8 mm and preferably 4-6 mm. In a side view it is preferred that the knives 4 will overlap slightly in height position, or at least very close to overlapping.

The knives 4 are preferably provided with teeth and the cutting edge 30 has preferably a wave form or the like, see FIG. 10, for example tops 31 and valleys 32. It is an advantage if the tops 31 are as pointy so there is only room for one tooth per top 31, thus the pressure will be concentrated to the top tooth when the cutting starts. This is especially an advantage when cutting tomatoes which has a tough skin but a soft inner. Tomatoes are easily squashed instead of cut.

In FIG. 11 a third embodiment of a slicer according to the present invention is shown. In this embodiment the knives are arranged slightly bent, for example 5-15 degrees, in order to enhance the stiffness of the knives 4, both side ways and in height.

In FIG. 15 another embodiment of the sets of knives 3 are shown. Here the knives 4 are arranged in a fan like way, i.e. not in parallel as a stair. Two sets 3 are shown and only one knife 4 of each set 3 is positioned in each level.

In FIG. 16 a fourth embodiment of the present invention is shown. Here three sets 3 of knives are present although one set 3 at one side does not comprise as many knives as the two other sets 3.

In FIG. 17 a fifth embodiment of the present invention is shown. In this embodiment two sets 3 of knives are present plus the starting knife 4' of a third set, to the left of the two sets 3 in the drawing, and a finishing knife 4" of a fourth set, to the right of the two sets 3 in the drawing. It is also conceivable to provide the single knives 4', 4" in other positions, for example in the second and third levels, respectively. Although, preferably not in the same level.

The invention claimed is:

1. A method for slicing vegetables and fruit, comprising:

a first cutting step wherein a first level of at least two knives starts cutting the vegetable or fruit to be cut, followed by at least a second cutting step where at least a second level of a corresponding number of knives as in the first level being laterally displaced and having the same internal distance in between the knives starts cutting the vegetable or fruit to be cut, and the knives in a latter cutting step are pushed in to an anvil part, where each set of knives are displaced in relation to each other, and every level of knives starts cutting subsequently after each other.

2. A vegetable and fruit slicer for slicing vegetables and fruit comprising a knife part and a cooperating anvil part, wherein the knife part comprises at least two sets of knives, each of said set of knives comprises at least two knives arranged at a predetermined lateral distance and a predetermined level distance from each other forming a stair or a fan, such that only one knife of each set is positioned at each level, wherein a lateral distance between respective knives of adjacent sets of knives positioned at the same level is the same for each level of knives, wherein said cooperating anvil part contains recesses arranged at a predetermined lateral distance and a predetermined level distance from each other forming a stair or a fan that correspond to each knife in the set of knives, and wherein the knife part and the anvil part are adapted for pushing together in a single direction to provide a sliced fruit or vegetable.

3. A vegetable and fruit slicer according to claim 2, wherein the knife part and the anvil part are swingably connected to each other via at least one hinge positioned transversally of the extension of the knives.

4. A vegetable and fruit slicer according to claim 2, wherein a guide means for guiding the knives into the recesses at use is/are provided at one of or both of the knife part and the anvil part.

5. A vegetable and fruit slicer according to claim 2, wherein the knives have toothed cutting edges.

6. A vegetable and fruit slicer according to claim 5, wherein the cutting edges have non-linear form showing tops and valleys.

7. A vegetable and fruit slicer according to claim 6, wherein there is only one tooth at the point of the tops.

8. A vegetable and fruit slicer according to claim 2, wherein a removable cleanser is provided in the anvil having one rung positioned in each recess.

9. A vegetable and fruit slicer according to claim 2, wherein the knives are arranged so that they are slightly bent in the direction of extension.

* * * * *